US008888608B2

(12) United States Patent
Ban et al.

(10) Patent No.: US 8,888,608 B2
(45) Date of Patent: Nov. 18, 2014

(54) GOLF CLUB HEAD

(71) Applicant: Bridgestone Sports Co., Ltd., Tokyo (JP)

(72) Inventors: Wataru Ban, Chichibu (JP); Kozue Wada, Minato-ku (JP); Tadahiro Narita, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 85 days.

(21) Appl. No.: 13/790,178

(22) Filed: Mar. 8, 2013

(65) Prior Publication Data

US 2013/0324296 A1 Dec. 5, 2013

(30) Foreign Application Priority Data

May 30, 2012 (JP) ..... 2012-123557

(51) Int. Cl.

*A63B 53/08* (2006.01)
*A63B 53/04* (2006.01)
*A63B 59/00* (2006.01)

(52) U.S. Cl.

CPC ..... *A63B 53/0466* (2013.01); *A63B 2059/0011* (2013.01); *A63B 2225/01* (2013.01); *A63B 2053/0412* (2013.01); *A63B 2053/0408* (2013.01)

USPC ..... 473/327; 473/345; 473/342

(58) Field of Classification Search

CPC ..... A63B 2059/0011; A63B 2225/01; A63B 2053/0416; A63B 53/08; A63B 2053/0408; A63B 2053/0412

USPC ..... 473/327, 342, 345

See application file for complete search history.

(56) References Cited

U.S. PATENT DOCUMENTS

| | | | | |
|---|---|---|---|---|
| 8,083,609 | B2 * | 12/2011 | Burnett et al. | 473/327 |
| 2009/0075752 | A1 * | 3/2009 | Hirano | 473/345 |
| 2011/0247190 | A1 * | 10/2011 | Evans et al. | 29/407.01 |
| 2012/0322578 | A1 * | 12/2012 | Ban et al. | 473/345 |

FOREIGN PATENT DOCUMENTS

| | | | |
|---|---|---|---|
| JP | 2011-528263 | A | 11/2011 |
| WO | 2010/008937 | A1 | 1/2010 |

* cited by examiner

*Primary Examiner* — Benjamin Layno
(74) *Attorney, Agent, or Firm* — Sughrue Mion, PLLC

(57) ABSTRACT

This invention provides a golf club head which includes a face portion, and has a volume of 400 cc or more. When the golf club head is disposed on a horizontal plane at a specific lie angle while the face portion is matched with the flight trajectory direction, and images of the face portion and the golf club head are projected onto a vertical plane from the front side of the face portion upon defining the flight trajectory direction as the projection direction, the area of a projected figure H of the golf club head is defined as HA, and the area of a projected figure F of the face portion is defined as FA. The golf club head satisfies 0.5<FA/HA<0.7, and a centroid Hc of the projected figure H coincides with a centroid Fc of the projected figure F.

11 Claims, 6 Drawing Sheets

GOLF CLUB HEAD

BACKGROUND OF THE INVENTION

1. Field of the Invention

The present invention relates to a golf club head.

2. Description of the Related Art

As the sizes of golf club heads typified by a wood golf club head increase each year, the influence of the air resistance upon a swing increases. As the air resistance increases, the head speed may lower, leading to a decrease in flight distance of a struck golf ball. Japanese Patent Laid-Open No. 2011-528263 proposes a golf club head manufactured using a technique of reducing the air resistance.

A golf club head preferably has a shape which allows the golfer to easily get ready for address. Therefore, when the air resistance is reduced by improving the head shape, a shape which makes the golfer experience too much incongruence is undesirable.

Also, during a swing, the orientation of the face portion with respect to the moving direction of the golf club head gradually changes, so the head moving direction comes close to the orientation of the face portion immediately before impact. To prevent a decrease in flight distance of a struck golf ball, it is effective to reduce the air resistance in the period from the last half of a down swing in which the golf club head accelerates until impact. In general, the face portion has a flat surface or slightly curved surface, and has a shape which is susceptible to the air resistance of an air current in a direction normal to this surface.

SUMMARY OF THE INVENTION

It is an object of the present invention to reduce the air resistance immediately before impact without making the golfer experience too much incongruence in terms of appearance.

According to the present invention, there is provided a golf club head which includes a face portion, and has a volume of not less than 400 cc, wherein when the golf club head is disposed on a horizontal plane at a specific lie angle while the face portion is matched with a flight trajectory direction, and images of the face portion and the golf club head are projected onto a vertical plane from a front side of the face portion upon defining the flight trajectory direction as a projection direction, an area HA of a projected figure H of the golf club head, and an area FA of a projected figure F of the face portion satisfy: $0.5<FA/HA<0.7$, and a centroid Hc of the projected figure H coincides with a centroid Fc of the projected figure F.

Further features of the present invention will become apparent from the following description of exemplary embodiments with reference to the attached drawings.

DESCRIPTION OF THE EMBODIMENTS

Figure 1:
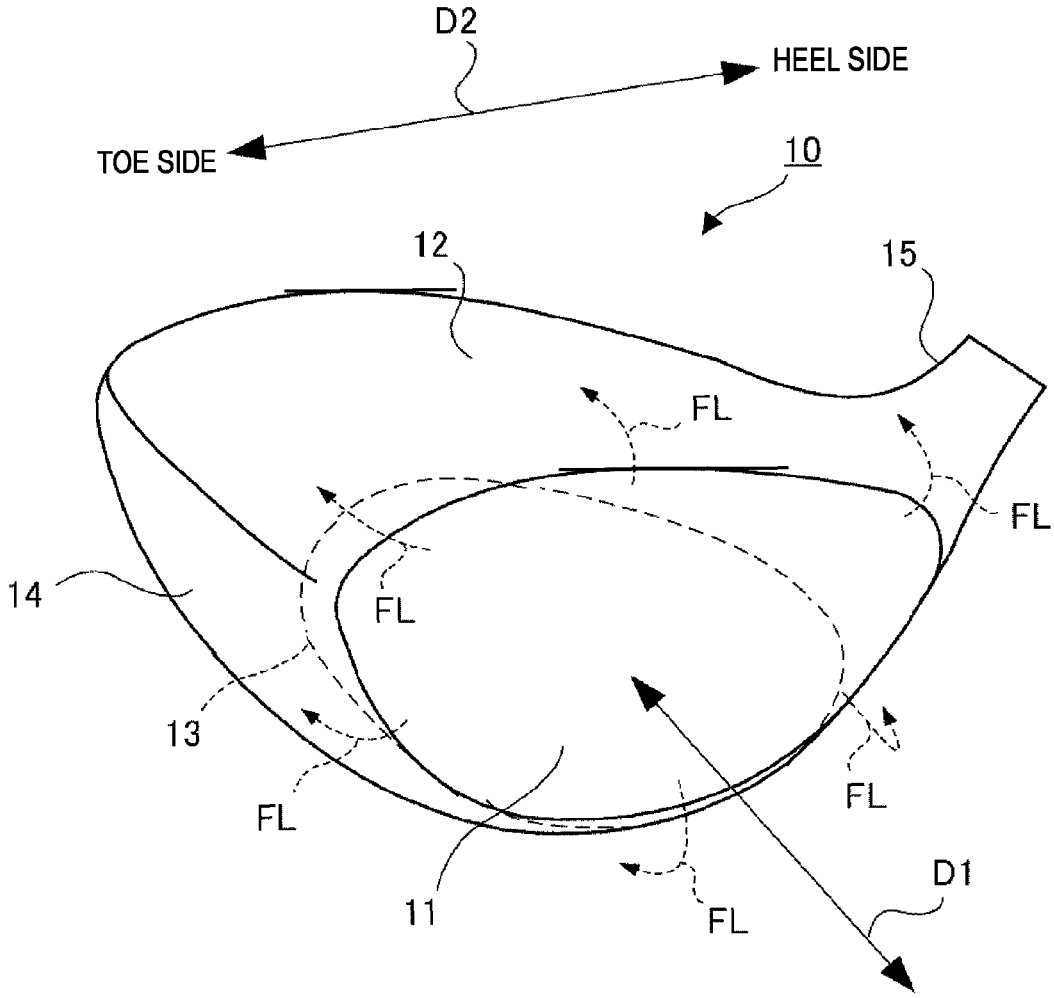
FIG. 1 is a perspective view of a golf club head according to an embodiment of the present invention.

FIG. 1 is a perspective view of a golf club head 10 according to an embodiment of the present invention. The golf club head 10 takes the form of a hollow body, and its peripheral wall constitutes a face portion 11 forming a face surface (striking surface), a crown portion 12 forming the upper portion of the golf club head 10, a sole portion 13 forming the bottom portion of the golf club head 10, and a side portion 14 forming the side portion of the golf club head 10. The side portion 14 includes toe-, heel-, and back-side portions. The golf club head 10 also includes a hosel portion 15 to which a shaft is attached. The golf club head 10 is assumed to have a volume of 400 cc or more, and preferably 500 cc or less.

The golf club head 10 is a driver golf club head. However, the present invention is suitable for wood golf club heads including not only a driver golf club head but also, for example, a fairway wood golf club head, utility (hybrid) golf club heads, and other hollow golf club heads. The golf club head 10 can be made of a metal material such as a titanium-based metal (for example, 6Al-4V-Ti titanium alloy), stainless steel, or a copper alloy such as beryllium copper.

The golf club head 10 can be assembled by bonding a plurality of parts. The golf club head 10 can be formed by, for example, a main body member and a face member. The main body member constitutes the peripheral portions of the crown portion 12, sole portion 13, side portion 14, and face portion 11, and has an opening partially formed in a portion corresponding to the face portion 11. The face member is bonded to the opening in the main body member.

Referring to FIG. 1, a double-headed arrow D1 illustrates the flight trajectory direction (the target direction of a struck golf ball). FIG. 1 assumes that the face portion 11 is matched with a flight trajectory direction D2. The double-headed arrow D2 indicates the toe-to-heel direction. The toe-to-heel direction is defined by a line which connects the toe- and heel-side ends of the sole portion 13.

The golf club head 10 ideally moves in a flight trajectory direction d1 immediately before impact. When the air resistance can be reduced at this time, the head speed can be increased or its decrease can be kept minimum. This embodiment is based on the idea that the air resistance can be reduced as an air current FL flowing from the face portion 11 to the periphery of the golf club head 10 becomes more uniform in each portion on the peripheral edge of the face portion 11. To produce a more uniform current, the shape of the face portion 11, and that of the golf club head 10 as viewed from the side of the face portion 11 are improved.

Figure 2A:
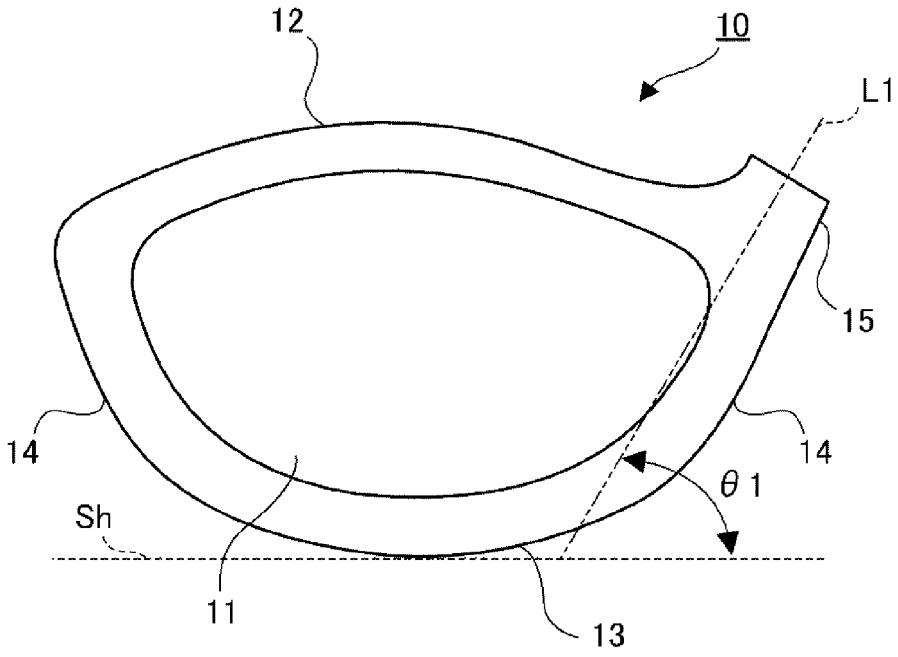
FIG. 2A is a view for explaining a reference orientation.

More specifically, first, assume that the golf club head 10 is disposed on a horizontal plane at a specific lie angle while the face portion 11 is matched with the flight trajectory direction D1 (to be also referred to as a reference orientation hereinafter). That is, the reference orientation means a state immediately before impact. FIG. 2A is a view for explaining a reference orientation. The golf club head 10 is assumed to be disposed on a virtual horizontal plane Sh at a specific lie angle θ1. A line L1 is the axis line of a shaft attached to the hosel portion 15. Note that when the specific lie angle is unknown, an average lie angle corresponding to the count of the golf club may be set. In the case of, for example, a driver golf club head, the specific lie angle is set to 59°.

Figure 2B:
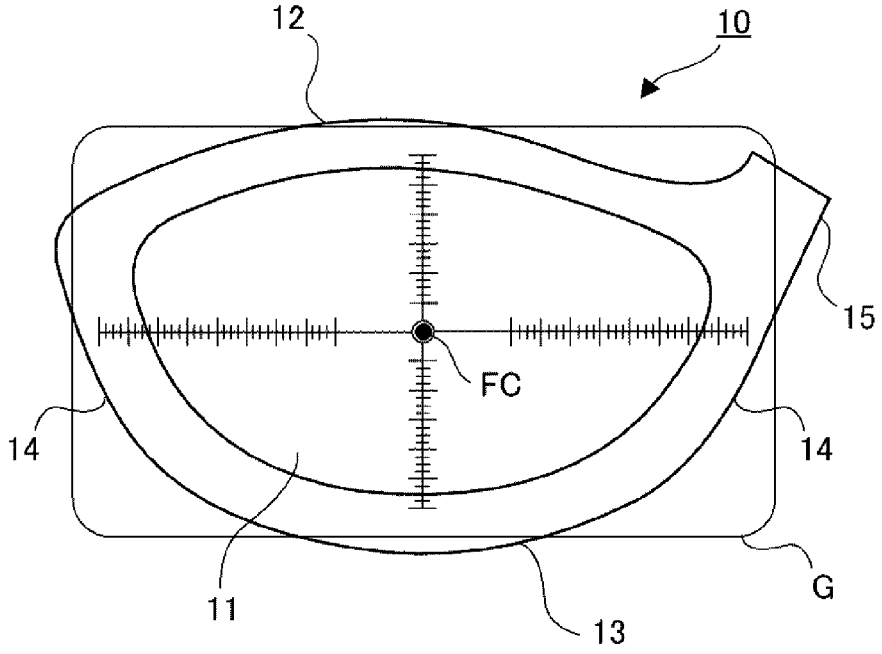
FIG. 2B is a view for explaining the face center.

The face portion 11 is regarded to be oriented in the flight trajectory direction D1 when the horizontal components of the face portion 11 in a direction normal to the face center are directed to the flight trajectory direction D1. FIG. 2B is a view for explaining the face center.

A gauge G having vertical and horizontal scales is put on the face portion 11, and a point at the center of the vertical and horizontal scales is defined as a face center FC, as shown in FIG. 2B. As the gauge G, a transparent thin plate having a hole formed at the intersection point between the vertical and horizontal scales, that is, a so-called impact point template can be used. The impact point template serves to specify the face center in measuring the CT value of the face portion.

Figure 3:
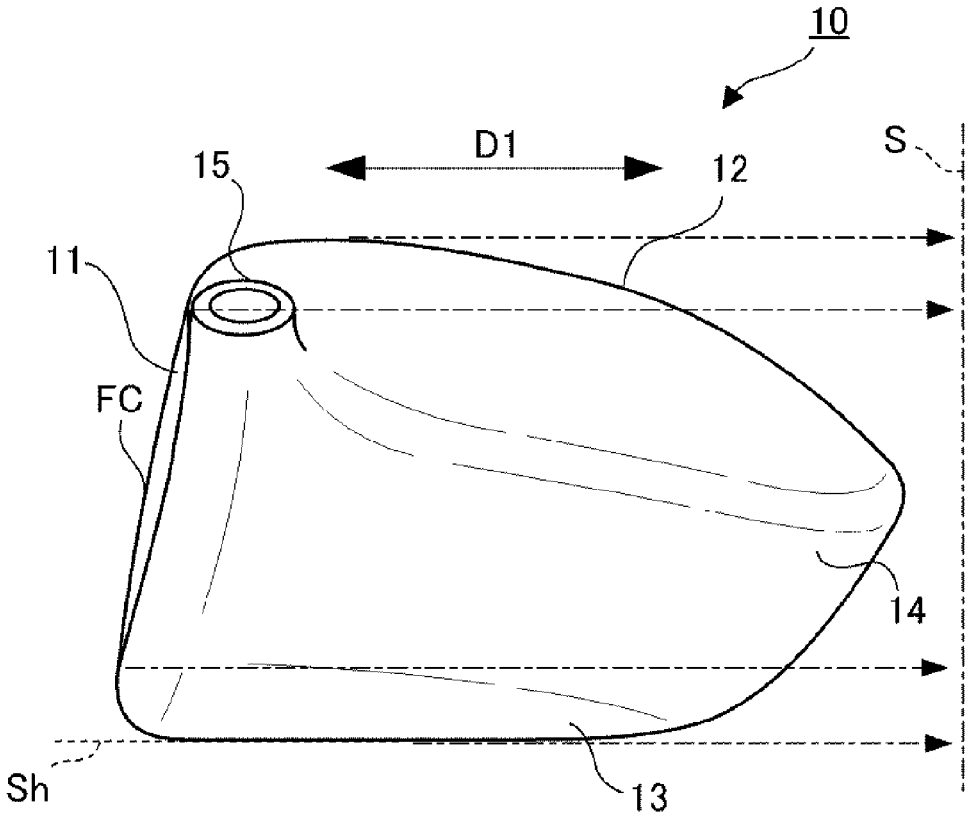
FIG. 3 is a view for explaining the projection direction.

Assuming that for a golf club head 10 in a reference orientation, images of the face portion 11 and golf club head 10 are projected onto a vertical plane S from the front side of the face portion 11 upon defining the flight trajectory direction D1 as the projection direction, as shown in FIG. 3, their projected figures are obtained. Such projected figures can be obtained by modeling the golf club head 10 on, for example, a CAD system.

Figure 4A:
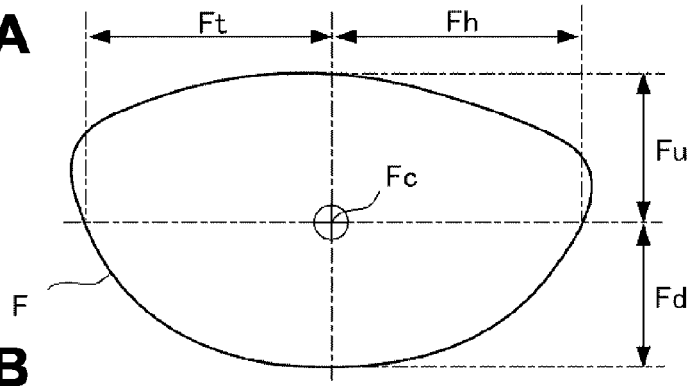
FIGS. 4A and 4B are views for explaining projected figures.
Figure 4B:
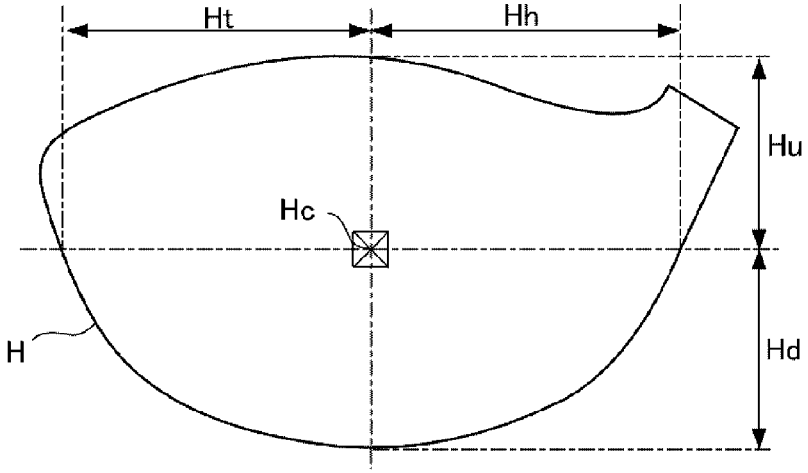

FIG. 4A shows a projected figure F of the face portion 11, and FIG. 4B shows a projected figure H of the golf club head 10. Note that reference symbol Fc denotes the centroid of the projected figure F; and Hc, the centroid of the projected figure H.

Figure 4C:
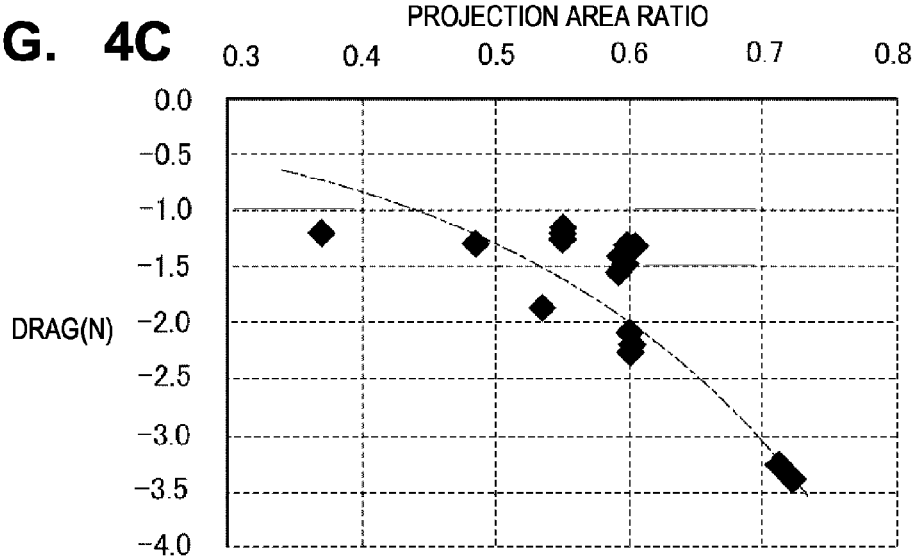
FIG. 4C is a graph showing the simulation result.

In this case, the relationship between the air resistance, and the area ratio between the projected figures F and H were simulated on the computer. FIG. 4C shows the simulation result.

In this simulation operation, a plurality of types of golf club head models that have different area ratios between the projected figures F and H, but have approximately the same conditions in other respects were used. The drag (N) when a golf club head model in a reference orientation is moved at 40 m/s in the flight trajectory direction in the air was calculated. In other words, an air resistance that acts on a golf club head when an average golfer swings is assumed. Referring to FIG. 4C, the drag value is positive in the moving direction of the golf club head model. This means that the resistance direction is defined as the negative direction. Letting FA be the area of the projected figure F of the face portion 11, and HA be the area of the projected figure H of the head 10, the area ratio is FA/HA.

As the area ratio increases, the drag also increases. If the area ratio is too low, it is often the case that the face portion 11 is considerably smaller than the contour of the head 10, so the golfer may feel incongruence in terms of head shape. Hence, 0.5<Area Ratio FA/HA is set. Note that an average golfer readily feels better when the golf club head 10 appears large as viewed from the front side. Hence, the area HA is preferably 5,500 $mm^2$ or more.

The drag value is not always proportional to the area ratio within the range of 0.5<FA/HA<0.7. When the head speed is 40 m/s, the drag is desirably 1.5 N or less, but some models have a drag less than 1.5 N within the range of 0.5<FA/HA<0.7. This means that the air resistance is expected to improve by adjusting conditions other than the area ratio FA/HA. Hence, 0.5<Area Ratio FA/HA<0.7 is set. When attention is paid to the centroids Fc and Hc of golf club head models belonging to this range, a decrease in drag of a model having adjacent centroids Fc and H was observed. This is presumably because the air resistance reduces as an air current flowing from the face portion 11 to the periphery of the golf club head 10 becomes more uniform in each portion on the peripheral edge of the face portion 11.

Figure 5A:
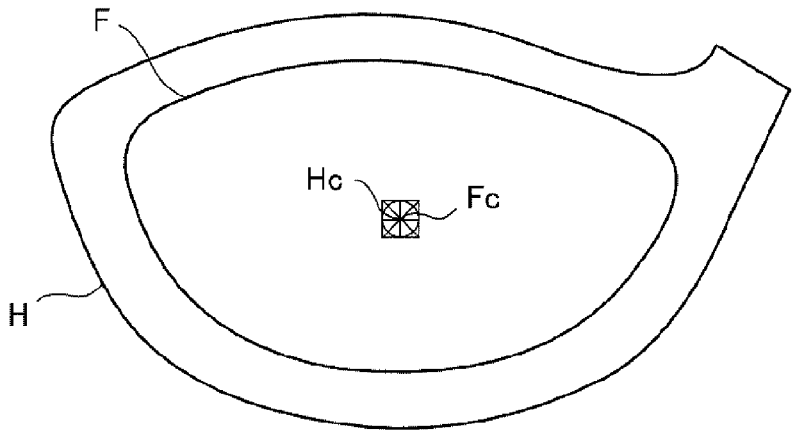
FIG. 5A is a view for explaining the centroid of a projected figure.

In view of this, the air resistance can be improved by matching the centroid Hc of the projected figure H with the centroid Fc of the projected figure F when, for a golf club head 10 in a reference orientation, images of the face portion 11 and golf club head 10 are projected onto a vertical plane from the front side of the face portion 11 upon defining the flight trajectory direction D1 as the projection direction, as shown in FIG. 5A. Note that taking into account, for example, manufacturing errors, the centroids Hc and Fc can be reckoned to coincide with each other when the distance between the centroids Hc and Fc is less than 5 mm.

As described above, in this embodiment, by setting 0.5<Area Ratio FA/HA<0.7, and matching the centroid Hc of the projected figure H with the centroid Fc of the projected figure F, the air resistance immediately before impact can be reduced without making the golfer experience too much incongruence in terms of appearance.

A preferable example of respective dimensions for the centroids Fc and Hc will be described herein with reference to FIGS. 4A and 4B. First, let Hu be the distance between the centroid Hc and an upper intersection point of the intersection points between the contour of the projected figure H and upper and lower lines which pass through the centroid Hc, and Hd be the distance between the centroid Hc and a lower intersection point. Also, let Fu be the distance between the centroid Fc and an upper intersection point of the intersection points between the contour of the projected figure F and upper and lower lines which pass through the centroid Fc, and Fd be the distance between the centroid Fc and a lower intersection point.

Similarly, let Ht be the distance between the centroid Hc and a toe-side intersection point of the intersection points between the contour of the projected figure H and lines which run in the toe-to-heel direction and pass through the centroid Hc, and Hh be the distance between the centroid Hc and a heel-side intersection point. Also, let Ft be the distance between the centroid Fc and a toe-side intersection point of the intersection points between the contour of the projected figure F and lines which run in the toe-to-heel direction and pass through the centroid Fc, and Fh be the distance between the centroid Fc and a heel-side intersection point.

In this case, Fu=Fd and Fu/Hu=Fd/Hd are preferably satisfied. With this arrangement, an air current flowing from the face portion 11 to the crown portion 12, and that flowing from the face portion 11 to the sole portion 13 can be made more uniform to reduce the air resistance. Note that taking into account, for example, manufacturing errors, Fu=Fd and Fu/Hu=Fd/Hd can be considered to approximately hold when |Fu−Fd|<3 mm and |Fu/Hu−Fd/Hd|<0.1.

Similarly, Ft=Fh and Ft/Ht=Fh/Hh are preferably satisfied. With this arrangement, an air current flowing from the face portion 11 to the crown portion 12, and that flowing from the face portion 11 to the sole portion 13 can be made more uniform to reduce the air resistance. Note that taking into account, for example, manufacturing errors, Ft=Fh and Ft/Ht=Fh/Hh can be considered to approximately hold when |Ft−Fh|<5 mm and |Ft/Ht−Fh/Hh|<0.1.

Also, 0.6<Fu/Hu=Fd/Hd=Ft/Ht=Fh/Hh<0.85 is preferably satisfied. If Fu/Hu=Fd/Hd=Ft/Ht=Fh/Hh≥0.6, the face portion 11 appears small, and provides a sense of incongruence. If Fu/Hu=Fd/Hd=Ft/Ht=Fh/Hh≤0.85, the rounded portion on the peripheral edge of the face portion 11 becomes small, so the air current is more likely to burble. Accordingly, as the above-mentioned numerical value range is set, the air current can be made more uniform in all directions: the upper, lower, right, and left directions from the face portion 11 to reduce the air resistance. Note that taking into account, for example, manufacturing errors, the values of Fu/Hu, Fd/Hd, Ft/Ht, and Fh/Hh can be considered to be approximately equal to each other when their differences are less than 0.1.

Figure 5B:
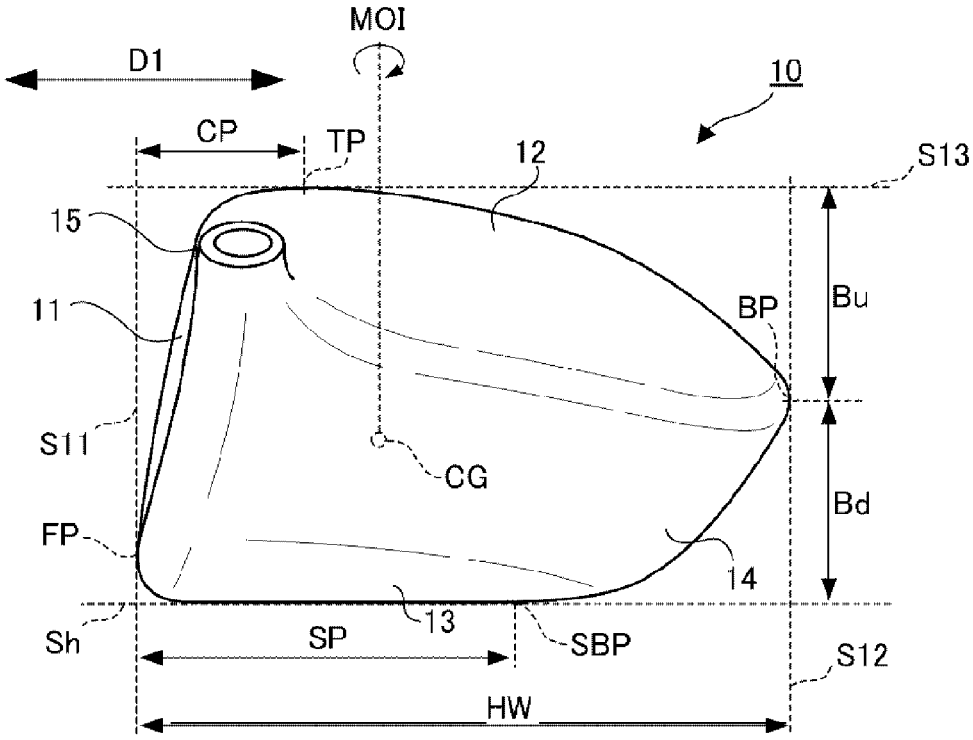
FIG. 5B is a view for explaining each dimension.

Another dimensional relationship which can reduce the air resistance will be described next with reference to FIG. 5B. FIG. 5B is a view showing a golf club head 10 in a reference orientation as viewed from the heel side in the horizontal direction perpendicular to the flight trajectory direction D1.

A vertical plane S11 is a virtual plane which passes through a front end FP of the golf club head 10 in the flight trajectory direction D1, and is perpendicular to the flight trajectory direction D1. A vertical plane S12 is a virtual plane which passes through a back end BP of the golf club head 10 in the flight trajectory direction D1, and is perpendicular to the flight trajectory direction D1. A horizontal plane S13 is a virtual plane which passes through a top TP of the golf club head 10.

Figure 6A:
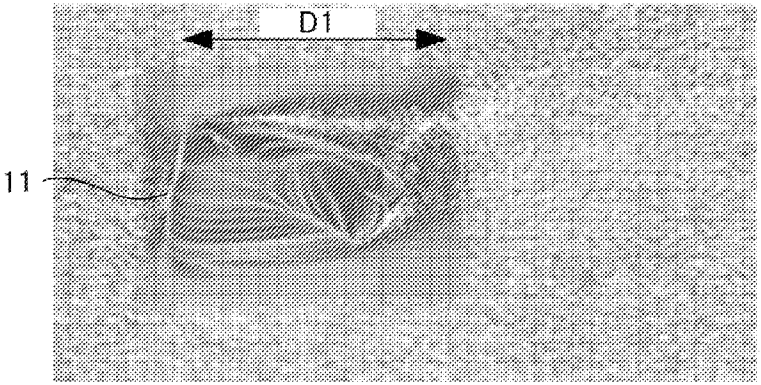
FIGS. 6A to 6D are views showing the simulation results.

Let CP be the horizontal distance from the front end FP to the top TP, and HW be the horizontal distance from the front end FP to the back end BP. In this case, $0.2<CP/HW<0.5$ is preferably satisfied. If $0.2\geq CP/HW$, the air current is more likely to burble in the crown portion 12. FIG. 6A shows the simulation result of a model when CP/HW=0.2, in which the air current burbles in the crown portion. If $CP/HW\geq 0.5$, this may provide a sense of incongruence in terms of head shape.

Figure 6B:
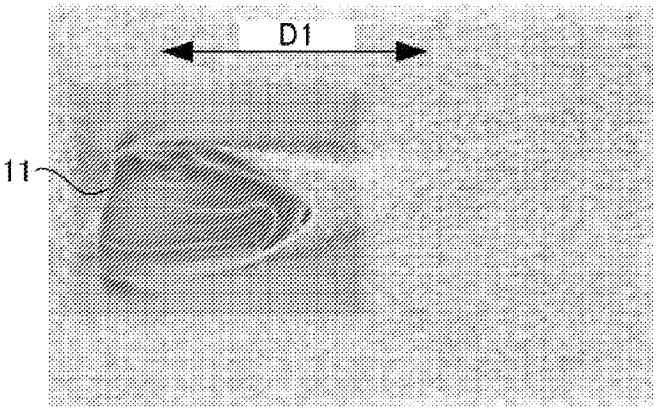

Referring to FIG. 5B, letting SP be the horizontal distance from the front end FP to a point SBP at which the sole portion 13 separates from the horizontal plane Sh, $0.3<SP/HW<0.7$ is preferably satisfied. If $0.3\geq SP/HW$, turbulence (curl up) of the air current on the back side of the golf club head 10 is large. FIG. 6B shows the simulation result of a model when SP/HW=0.3, in which the air current curls up on the back side of the golf club head 10.

Figure 6C:
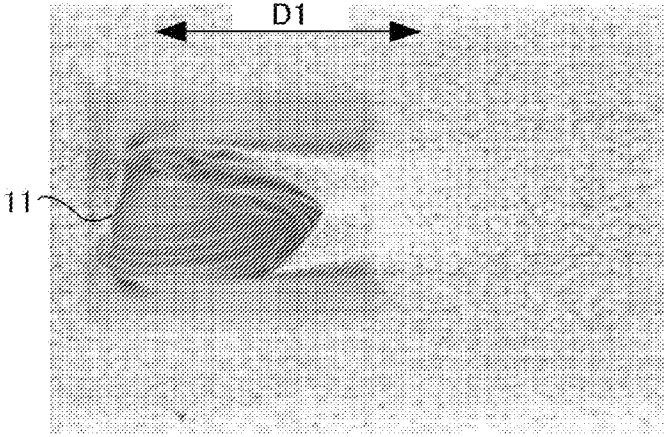
Figure 6D:
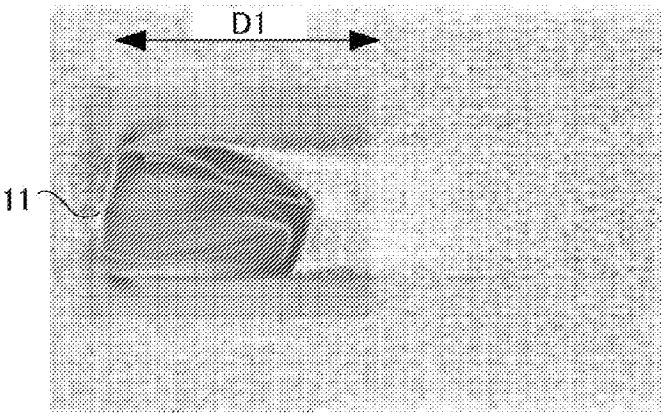

FIG. 6C shows the simulation result of a model when SP/HW=0.5, in which the air current almost horizontally expands on the back side of the golf club head 10, that is, a desirable air current is formed. If $SP/HW\geq 0.7$, the balance (the balance between the upper and lower sides) of the air current on the back side of the golf club head 10 degrades. FIG. 6D shows the simulation result of a model when SP/HW=0.7, in which the air current flowing backwards from the crown portion, and that flowing backwards from the sole portion are asymmetric, so the balance is poor.

Referring to FIG. 5B, letting Bu be the vertical distance from the back end BP to the top TP, and Bd be the vertical distance from the back end BP to the bottom (horizontal plane Sh) of the golf club head 10. In this case, Bu=Bd is desirable. With this arrangement, the balance (the balance between the upper and lower sides) of the air current on the back side of the golf club head 10 can be easily improved, as shown in an example of FIG. 6C. Note that taking into account, for example, manufacturing errors, Bu=Bd can be considered to approximately hold when $|Bu-Bd|<3$ mm.

Referring again to FIG. 5B, attention is paid to the moment of inertia (MOI) of the golf club head 10. The MOI is the moment of inertia about a vertical line which passes through the center of gravity CG of the golf club head 10. In this embodiment, the MOI is preferably 4,000 $g\cdot cm^2$ or more when the golf club head 10 is set in a reference orientation. A decrease in flight distance can be suppressed even if the striking point of a golf ball deviates from the sweet spot of the golf club head 10 (even in the case of a so-called off-center hit).

A dimensional relationship for increasing the MOI while reducing the air resistance will be described. When the values Ht, Hh, Hu, and Hd described with reference to FIG. 4B satisfy Hw=Ht+Hh and Hz=Hu+Hd, $1.2<Hw/Hz<1.8$ is preferably satisfied. If $Hw/Hz\leq 1.2$, the golf club head 10 has a shape close to a sphere, thus making it difficult to increase the MOI. If $Hw/Hz\geq 1.8$, the golf club head 10 becomes too flat to form a shape having a low air resistance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-123557, filed May 30, 2012, which is hereby incorporated by reference herein in its entirety.

What is claimed is:

1. A golf club head which includes a face portion, and has a volume of not less than 400 cc, wherein when the golf club head is disposed on a horizontal plane at a specific lie angle while the face portion is matched with a flight trajectory direction, and images of the face portion and the golf club head are projected onto a vertical plane from a front side of the face portion upon defining the flight trajectory direction as a projection direction, an area HA of a projected figure H of the golf club head, and an area FA of a projected figure F of the face portion satisfy:

$$0.5<FA/HA<0.7, \text{ and}$$

a centroid Hc of the projected figure H coincides with a centroid Fc of the projected figure F.

2. The head according to claim 1, wherein the area HA is not less than 5,500 $mm^2$.

3. The head according to claim 1, wherein letting Hu be a distance between the centroid Hc and an upper intersection point of intersection points between a contour of the projected figure H and an upper line and a lower line which pass through the centroid Hc, and Hd be a distance between the centroid Hc and a lower intersection point, and letting Fu be a distance between the centroid Fc and an upper intersection point of intersection points between a contour of the projected figure F and an upper line and a lower line which pass through the centroid Fc, and Fd be a distance between the centroid Fc and a lower intersection point, $$Fu=Fd, \text{ and}$$

$$Fu/Hu=Fd/Hd.$$

4. The head according to claim 1, wherein letting Ht be a distance between the centroid Hc and a toe-side intersection point of intersection points between a contour of the projected figure H and lines which run in a toe-to-heel direction and pass through the centroid Hc, and Hh be a distance between the centroid Hc and a heel-side intersection point, and letting Ft be a distance between the centroid Fc and a toe-side intersection point of intersection points between a contour of the projected figure F and lines which run in the toe-to-heel direction and pass through the centroid Fc, and Fh be a distance between the centroid Fc and a heel-side intersection point, $$Ft=Fh, \text{ and}$$

$$Ft/Ht=Fh/Hh.$$

5. The head according to claim 1, wherein letting Hu be a distance between the centroid Hc and an upper intersection point of intersection points between a contour of the projected figure H and an upper line and a lower line which pass through the centroid Hc, and Hd be a distance between the centroid Hc and a lower intersection point, letting Fu be a distance between the centroid Fc and an upper intersection point of intersection points between a contour of the projected figure F and an upper line and a lower line which pass through the centroid Fc, and Fd be a distance between the centroid Fc and a lower intersection point, letting Ht be a distance between the centroid Hc and a toe-side intersection point of intersection points between a contour of the projected figure H and lines which run in a toe-to-heel direction and pass through the centroid Hc, and Hh be a distance between the centroid Hc and a heel-side intersection point, and letting Ft be a distance between the centroid Fc and a toe-side intersection point of intersection points between a contour of the projected figure F and lines which run in the toe-to-heel direction and pass through the centroid Fc, and Fh be a distance between the centroid Fc and a heel-side intersection point, $$0.6<Fu/Hu=Fd/Hd=Ft/Ht=Fh/Hh<0.85.$$

6. The head according to claim 1, wherein when the golf club head is disposed on a horizontal plane at a specific lie angle while the face portion is matched with a flight trajectory direction, a horizontal distance CP from a front end of the golf club head to a top of the golf club head, and a horizontal distance HW from the front end to a back end of the golf club head satisfy:

$$0.2<CP/HW<0.5.$$

7. The head according to claim 1, wherein the golf club head includes a sole portion, and when the golf club head is disposed on a horizontal plane at a specific lie angle while the face portion is matched with a flight trajectory direction, a horizontal distance SP from a front end of the golf club head to a point at which the sole portion separates from the horizontal plane, and a horizontal distance HW from the front end to a back end of the golf club head satisfy:

$$0.3<SP/HW<0.7.$$

8. The head according to claim 1, wherein when the golf club head is disposed on a horizontal plane at a specific lie angle while the face portion is matched with a flight trajectory direction, a vertical distance Bu from a back end of the golf club head to a top of the golf club head, and a vertical distance Bd from the back end to a bottom of the golf club head satisfy:

$$Bu=Bd.$$

9. The head according to claim 1, wherein a drag when the golf club head is disposed on a horizontal plane at a specific lie angle while the face portion is matched with a flight trajectory direction, and the golf club head moves at 40 m/s in the flight trajectory direction in the air is not more than 1.5 N.

10. The head according to claim 1, wherein letting Hz be a distance between intersection points between a contour of the projected figure H and an upper line and a lower line which pass through the centroid Hc, and letting Hw be a distance between intersection points between the contour of the projected figure H and lines which run in a toe-to-heel direction and pass through the centroid Hc, $$1.2<Hw/Hz<1.8.$$

11. The head according to claim 1, wherein when the golf club head is disposed on a horizontal plane at a specific lie angle while the face portion is matched with a flight trajectory direction, a moment of inertia about a vertical line which passes through the center of gravity of the golf club head is not less than 4,000 $g\cdot cm^2$.

* * * * *